US005890882A

United States Patent [19]

Feldman

[11] Patent Number: 5,890,882

[45] Date of Patent: Apr. 6, 1999

[54] INFLATOR WITH DROP-IN BATTERIES AND UNIVERSAL ADAPTERS

[75] Inventor: Robert M. Feldman, Newton, Mass.

[73] Assignee: Innovative Air Products, Inc., Wauconda, Ill.

[21] Appl. No.: 960,879

[22] Filed: Oct. 30, 1997

Related U.S. Application Data

[63] Continuation of Ser. No. 778,841, Jan. 6, 1997, abandoned.

[51] Int. Cl.[6] ..... F04B 35/04

[52] U.S. Cl. ..... 417/411; 417/572; 5/713

[58] Field of Search ..... 5/713; 417/411, 417/423.1, 423.14, 572

[56] References Cited

U.S. PATENT DOCUMENTS

| | | | |
|---|---|---|---|
| 4,734,017 | 3/1988 | Levin | 417/411 |
| 4,987,975 | 1/1991 | Liu | 417/411 |
| 5,115,566 | 5/1992 | Zeitlin | 417/411 |
| 5,127,808 | 7/1992 | Nichols et al. | 417/411 |
| 5,267,363 | 12/1993 | Chaffee | 5/713 X |
| 5,658,128 | 8/1997 | Green | 417/411 |

*Primary Examiner*—Charles G. Freay

*Attorney, Agent, or Firm*—Mason, Kolehmainen, Rathburn & Wyss

[57] ABSTRACT

A portable, battery powered inflator with removable batteries which are switch activated. The inflator has an air intake and output for delivering air into a variety of air bladders with different sized valves. The batteries are typical dry cells and not rechargeable to save cost. The inflator has a cover that allows quick removable and replacement of the batteries. An adapter assembly including a transition structure and adapters are provided to allow inflation of a variety of bladders having different sized valves. The attaching of the transition structure engages the switch completing an electrical circuit that activates the motor to deliver air automatically.

14 Claims, 3 Drawing Sheets

INFLATOR WITH DROP-IN BATTERIES AND UNIVERSAL ADAPTERS

This application is a continuation of U.S. application Ser. No. 08/778,841, filed Jan. 6, 1997, now abandoned.

The present invention relates generally to the field of low pressure inflators for pneumatic bladders, and more specifically to low cost, portable inflators used with a variety of bladders with different sized inflation valves, e.g. full sized or larger air mattresses, balls, inflatable water toys, and the like.

BACKGROUND OF THE INVENTION

Air beds with pneumatic bladders with manual and motorized inflators are known. These devices are described in several U.S. Pat. No. 4,977,633 which issued on Dec. 18, 1990; U.S. Pat. No. 5,267,363 which issued on Dec. 7, 1993, and U.S. Pat. No. 5,367,726 which issued on Nov. 29, 1994, all to Robert Chaffee. These three patents which indicate the general state of the art are hereby incorporated by reference herein as if laid out in full.

The above inventions of the Chaffee patents and other battery powered inflators are known. The requirement of portability dictates the use of battery powered inflators since many applications of such inflators are at locations devoid of typical AC electricity power outlets. For example, campsites and swimming locations often have no electricity, but air mattresses and inflatable water tubes and the like are commonplace.

However, battery powered inflators are designed and adapted for use with a particular bed or other such specific bladder that has a particular inlet valve. Moreover, such battery powered inflators have been developed with rechargeable batteries that are maintenance free while providing long life. One limitation is that these rechargeable batteries are expensive, and since rechargeable, the batteries are not designed for easy removal or replacement.

These known devices have other limitations. One such limitation is the inability to adapt to different sized inlet valves. Typically a large bladder, like an adult sized air mattress, has a larger inlet valve than a small child's tube. The larger sized valve provides faster inflation and/or deflation times, but may be incompatible for use with a child's small air tube.

Another limitation stems from the low pressures associated with air bladders in general. With low pressure but often high volume air flows any impediment to the air flow increases the inflation time significantly. When an inflator is attached to an air mattress with a valve such as described in the above incorporated patents the force needed to overcome the spring force that typically is used to close the diaphragm in the valve in the air mattress, even a small spring force, may significantly increase the time to fully inflate the mattress.

In applications where an inflator is occasionally or rarely used there is a need for an inexpensive inflator. It is an object of the present invention to use inexpensive, dry cell batteries which can be easily replaced.

It is an object of the present invention to provide an inflator with batteries that are easily and quickly changed.

It is an object of the present invention to provide a simpler, less expensive inflator, which minimizes the air flow resistance of diaphragm valves used in air bladders.

It is yet another object of the present invention to provide an adapter for allowing the inflator to be used to inflate a wide variety of bladders, from small toy bladders to larger air mattresses or other such large bladders.

SUMMARY OF THE INVENTION

The above objects are met in a battery powered inflator that uses standard sized, inexpensive, common dry cell batteries that are not rechargeable. An advantage of such an inflator is that the inflator is less expensive and less complicated. An adapter useful for a range of different bladder inlet valves is provided wherein the inflator can be substantially universally applied to any air bladder. Another advantage of the present invention is provided by means incorporated in the inflator which mechanically opens the diaphragm of valves used in many air mattresses so as to minimize the air flow resistance of the valve and to therefore minimize the time to inflate the mattress.

An inflation device may include a container or housing having an air inlet and air outlet, and a battery compartment within the container that is adapted to hold two or more batteries. The batteries are releasably retained within the compartment, and supply electrical energy to an electrically activated motor disposed within the container. An air impeller connected to the motor drives air from the inlet to the outlet when the motor is activated. A switch disposed within the container can be opened or closed to make or break the electrical circuit between the batteries and the motor. A transition structure is adapted to be removably attached to the air outlet. The transition structure has an extension that closes the switch and is attached to the air outlet. The transition structure additionally has an in port for accepting air from the air outlet and an out port through which air is delivered. Two or more adapters can be detachably mounted to the transition structure or to the container. Each of the adapters has a first end for attaching to and accepting air from the out port, and a second opening for delivering the accepted air into different sized valves.

Advantages of the present invention include: low cost (expensive rechargeable batteries are not required); no requirement for recharging equipment; and portability (the inflator can be used where no AC power service is available).

BRIEF DESCRIPTION OF THE DRAWINGS

Other objects, features and advantages will be apparent from the following detailed description of preferred embodiments thereof taken in conjunction with the accompanying drawings in which.

DETAILED DESCRIPTION OF PREFERRED EMBODIMENTS

Figure 1A:
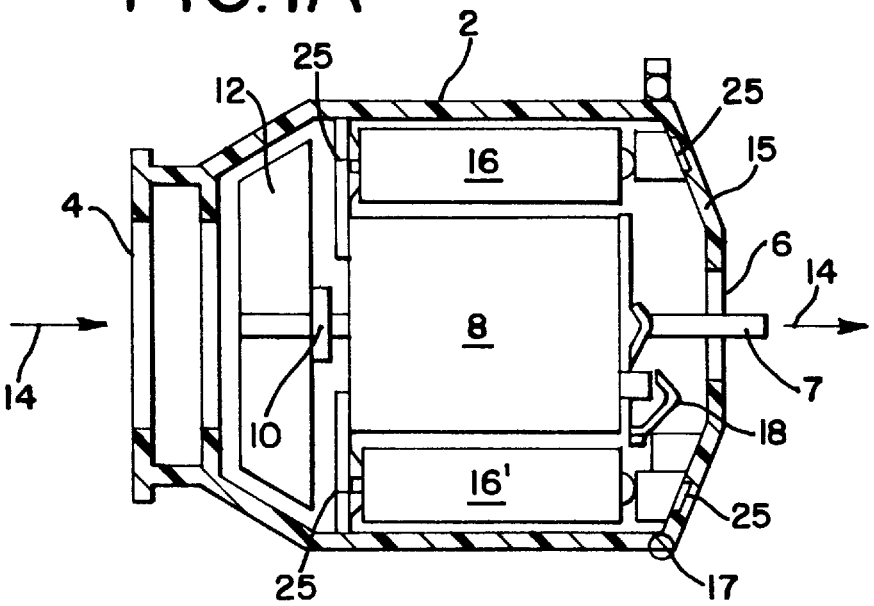
FIG. 1A is a cross section view of an inflator embodying the present invention.

FIG. 1A shows a housing 2 with an air intake 4 and an air outlet 6. An electrical motor 8 is centrally mounted and a rotor part 10 is attached to an air impeller 12 which as indicated by arrows 14, sucks in air and delivers air out the outlet 6. There are passageways in and around the motor 8 to allow the air to easily pass through. Two batteries 16 and 16' are shown in compartments that surround the motor 8. The housing 2 may be sized with many battery compartments built of any applicable size. In a preferred embodiment four "D" sized dry cells are used. However, other types and numbers can be used to advantage.

An electrical circuit is provided in the inflator housing 2 with electrical conductors 25 arranged to connect the batteries 16, 16' and the motor 8 so that the motor 8 can be activated when power is supplied from the batteries 16, 16' to the motor 8. The batteries may be mounted on springs as is well known in the art to provide secure electrical connections thereto. The electrical connections and circuitry are well known in the art wherein the batteries may be connected in parallel or series or combinations thereof as determined by the batteries and the motor design. A switch 18 (diagrammatically shown in FIG. 1A) is incorporated to allow completion of the circuit and activation of the motor 8. Details of such switches are described in the incorporated patents, and are well known in the art. In this preferred embodiment arrangements are made to close the switch and automatically activate the motor by attaching an air adapter or a transition structure. However, an external, manually activated (not shown) switch is provided in other preferred embodiments.

Still referring to FIG. 1A, a post 7 extends directly from the middle of the inflator which is of a length to mechanically push open the plastic frame of a diaphragm valve used in air mattresses. Being centered allows the post 7 to not interfere with the adapters later described. Even though the force needed to open such valves is on order of a few ounces the elimination of the need to open the valve provides for 10 percent to as much as 50% and more reduction in the time to inflate a bladder.

Figure 1B:
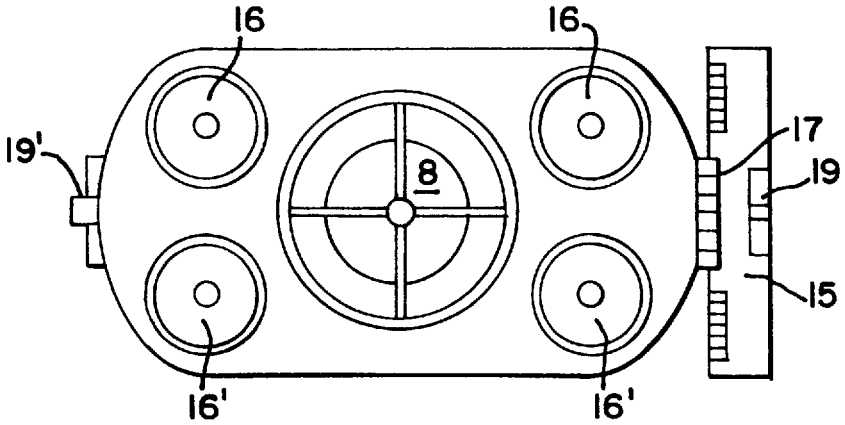
FIG. 1B is a top view of the inflator of FIG. 1A with the top cover opened.
Figure 1C:
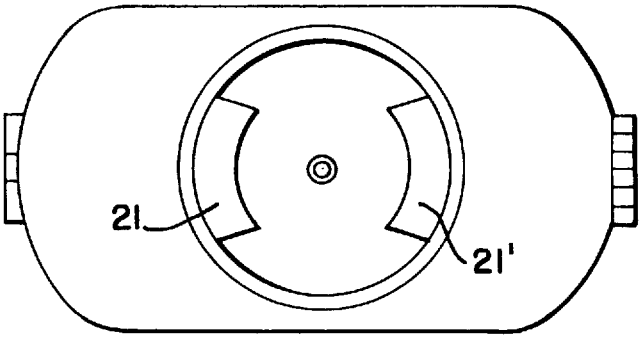
FIG. 1C is the top view of the inflator of FIG. 1A similar to FIG. 1B but with the top closed.

FIG. 1B is a top view of the inflator showing the four D-size batteries 16, 16' that can be used in the inflator. A cover 15 is hinged at 17 and has a latch 19 that is adapted to engage a latch 19' on the side of the battery compartment. FIG. 1C shows the cover 15 closed and the retaining extensions 21 and 21'.

Figure 2A:
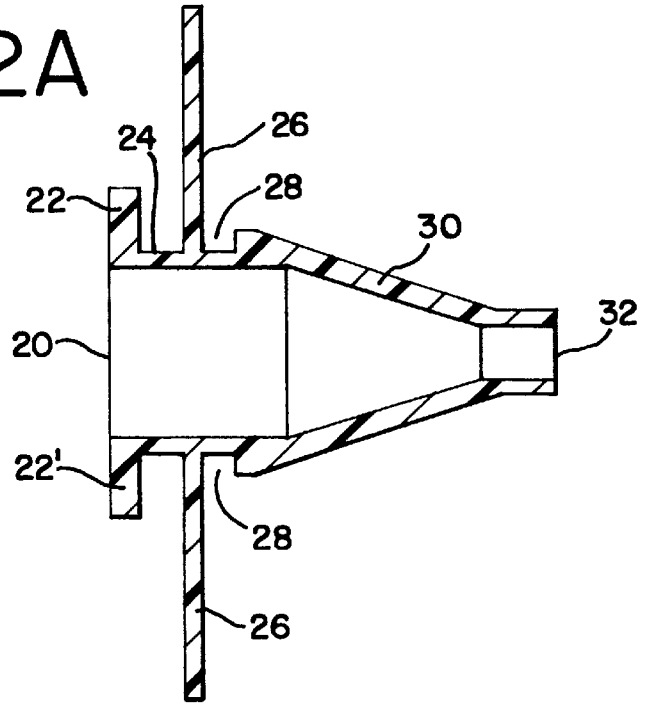
FIG. 2A is a cross section view of an air outlet adapter for attachment to the inflator illustrated in FIGS. 1A–1C.

FIG. 2A shows a transition adapter structure in cross section. Ears 22 and 22' extend from opposite sides of an opening 20 in a tubular body 24. An encircling flange 26 is provided, and just above the flange 26 there is a groove 28 discussed below that also encircles the body 24. The other end includes a tapered section 30 that extends to an outlet opening 32. The tapered end is designed with a pliable material that makes a substantially air tight seal when it is inserted into any inlet valve on a bladder with an internal diameter that mates with the tapered part 30. As discussed below other adapters are provided for inlet valves that are not accommodated by the transition adapter.

Figure 2B:
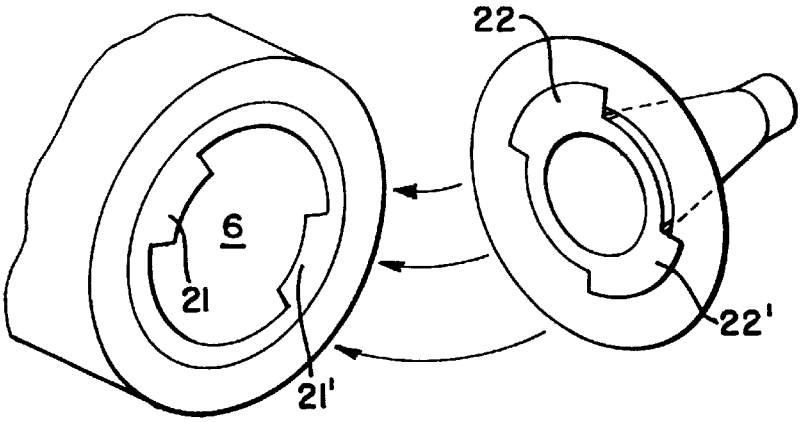
FIG. 2B is a perspective view illustrating the mating of the adapter to the inflator illustrated in FIGS. 1A–1C.
Figure 2C:
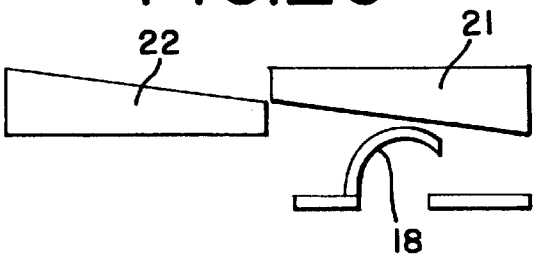
FIGS. 2C and 2D are diagrammatic views illustrating how the mating ears of an adapter activates the motor switch of the inflator illustrated in FIGS. 1A–1C.
Figure 2D:
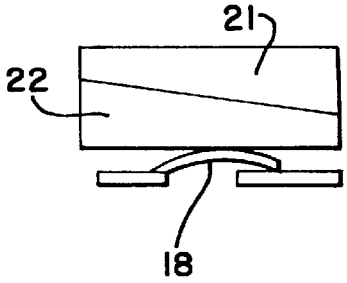

FIG. 2B shows the ears 22 and 22' of the transition adapter structure that fit into the opening 6 of the inflator also shown in FIG. 1A. Mating extensions 21 and 21' are adapted to accept and retain the ears 22, 22'. As shown in FIGS. 2C and 2D, the ears 22 and the extensions 21 are matingly tapered such that as the inserted transition adapter structure is rotated relative to the inflator the ear 22 or 22' will engage the electrical switch 28 and force the switch closed thereby activating the motor 8 and causing air to be delivered.

Figure 3:
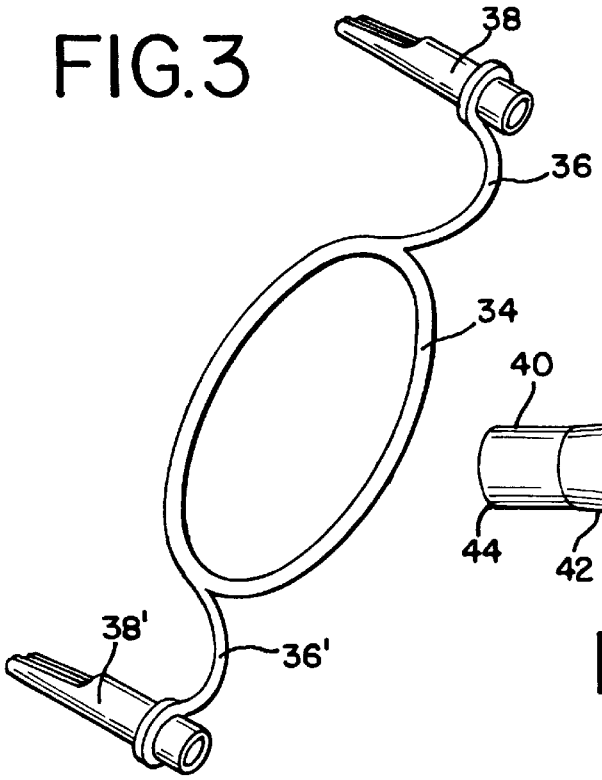
FIG. 3 is a perspective view of a detachable ring for the inflator illustrated in FIGS. 1A–1C to which is attached adapters by tethers.

FIG. 3 shows a ring 34 with two tethers 36 and 36' extending therefrom, each of which tethers has an adapter 38 or 38' at its end. The ring 34 is made of pliable material and is placed in the groove 28 so that the tethered adapters 38 and 38' are retained with the transition structure.

Figure 4:
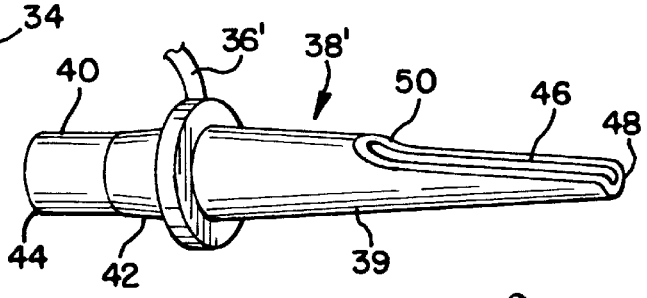
FIG. 4 is a perspective view of an adapter of the type illustrated in FIG. 3.

FIG. 4 shows a detail of an adapter 38'. The only difference between the adapter 38' and the adapter 38 shown in FIG. 3 is that adapter 38' is larger than adapter 38. The adapter 38' has a tubular section 40 with an outside diameter (OD) at an end 44 that fits into the opening 32 of the transition structure shown in FIG. 2A. The tubular OD becomes larger due to the outward tapering of the outside surface 42. The material is pliable so that the end 44 fits snugly into the opening 32 (FIG. 2A) and when pressed farther into the opening 32 the larger OD at 42 provides an interference fit that retains the adapter to the transition structure and make a substantially air tight seal. The adapter 38' is connected to the tether 36' at a point distal from the end 44 to allow adequate fitting of the adapter 38' to the transition structure. The other end 39 of the adapter 38' is a tubular body that tapers to an extended opening 46. The end 48 is designed to fit into and open the air valve in an air bladder. The adapter 38' is pressed into the bladder up to a point 50 where the opening 46 ends and the diameter of the adapter becomes substantially larger. The point 50 is designed to engage the air bladder valve and prevent farther insertion. The material of the adapters is pliable allowing insertion that will not damage the air valve while providing compliance for an air tight seal. In each of these cases there is only a few pounds per square inch (psi) or less of air pressure involved. Although two adapters are shown more are used in other preferred embodiments. In fact an adapter can be fashioned for substantially any air bladder valve type and/or opening.

Figure 5:
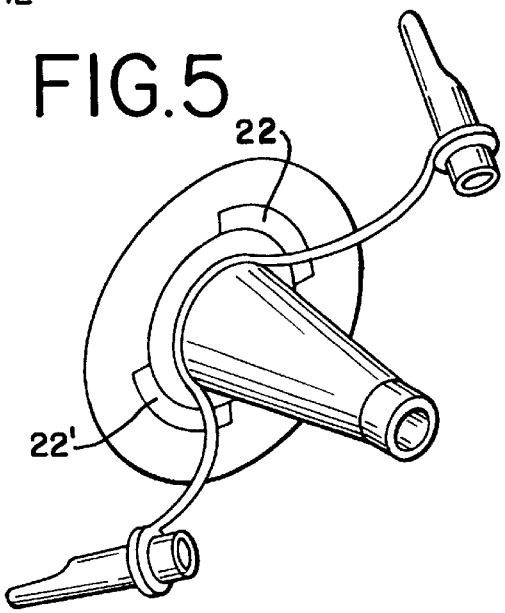
FIG. 5 is a perspective view of the tethered adapters of FIG. 3 attached to the adapter of FIG. 2A.

FIG. 5 shows the tethered adapters attached to the transition structure.

Figure 6:
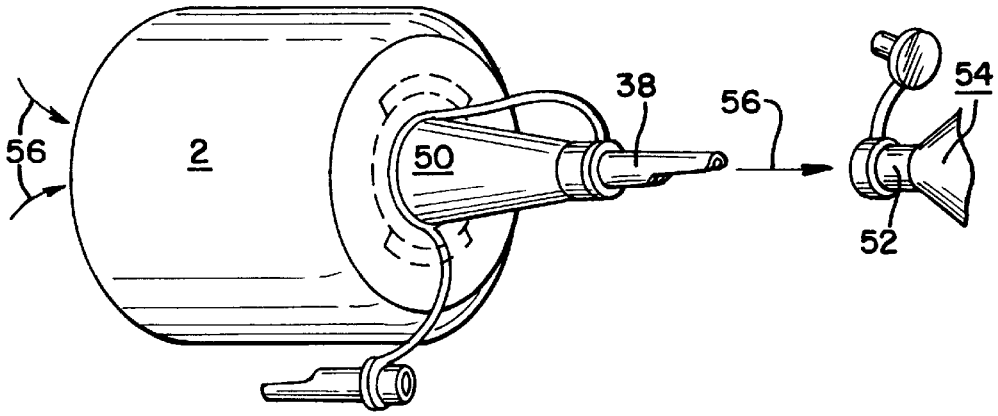
FIG. 6 is a perspective view illustrating how the tethered adapter of FIG. 5 can be used to supply air into an air bladder.

FIG. 6 shows a composite of the inflator housing 2, and attached transition structure 50 with an adapter 38 ready to be inserted into a valve 52 of a bladder 54. As shown by arrows 56, air is being delivered and directed to the valve 52. Alternatively, the adapter could be placed into the bladder valve and then attached to the motor activating the air delivery into the bladder. In other preferred embodiments a manually activate electrical switch could be used to activate the inflator by the operator as desired.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An inflator apparatus for inflating a bladder comprising:

an inflator housing having an air inlet and an air outlet;

a battery operated motor with an impeller disposed within said inflator housing, said impeller driving air from said air inlet to said air outlet when said motor is activated;

a battery compartment within said inflator housing for housing at least two non-rechargeable batteries, said battery compartment having a cover for providing access to said battery compartment; and an electrical connection circuit for coupling said batteries to said motor, said electrical connection circuit including a switch having first and second operating modes, said motor being activated by said batteries when said switch is in said first operating mode and being deactivated when said switch is in said second operating mode.

2. The inflator apparatus for inflating a bladder as set forth in claim 1 wherein said cover is hingedly mounted on said inflator housing and pivotable between an open position wherein said batteries can be inserted or removed from said battery compartment and a closed position wherein said batteries are retained in said battery compartment.

3. The inflator apparatus for inflating a bladder as set forth in claim 1 wherein said bladder has a valve that includes a sealing mechanism that is movable between at least opened and closed positions and wherein said inflator housing includes a post extending centrally from said air outlet so as to move said sealing mechanism to said open position when said inflator apparatus is mated with said valve of said bladder.

4. The inflator apparatus for inflating a bladder as set forth in claim 1 wherein said switch is disposed at said air outlet and including a transition structure that is adapted to be detachably mounted on said air outlet such that said switch is in said first operating mode when said transition structure is mounted on said air outlet.

5. The inflator apparatus for inflating a bladder as set forth in claim 4 wherein said bladder has a valve through which air is directed for inflating said bladder and wherein said inflator apparatus includes a plurality of adapters for interconnecting said transition structure to said valve, each of said adapters being maintained in proximity to transition structure by a tether.

6. The inflator apparatus for inflating a bladder as set forth in claim 5 wherein said transition structure has a transition structure inlet for mating with said air outlet and a transition structure outlet and wherein each of said adapters has an adapter inlet for mating to said transition structure outlet and an adapter outlet, said adapter outlet of each of said adapters being of different sizes.

7. An inflator apparatus for inflating a bladder having a valve that includes a sealing mechanism that is movable between at least opened and closed positions, said inflator apparatus comprising:

an inflator housing having an air inlet and an air outlet;

a motor with an impeller disposed within said inflator housing, said impeller driving air from said air inlet to said air outlet when said motor is activated; and a post extending centrally from said air outlet so as to move said sealing mechanism from said closed position to said open position when said inflator apparatus is mated with said valve of said bladder.

8. An inflator apparatus for inflating a bladder having a valve through which air is supplied into said bladder, said inflator apparatus comprising:

an inflator housing having an air inlet and an air outlet;

a motor with an impeller disposed within said inflator housing, said impeller driving air from said air inlet to said air outlet when said motor is activated;

a transition structure having a transition structure inlet for mating with said air outlet and a transition structure outlet; and a plurality of adapters for interconnecting said transition structure to said valve, each of said adapters having an adapter inlet for mating to said transition structure outlet and an adapter outlet, said adapter outlet of each of said adapters being of different sizes.

9. The inflator apparatus for inflating a bladder as set forth in claim 8 wherein said air outlet includes mating means and said transition structure inlet includes ears for mating with mating means to retain said transition structure with respect to said air outlet.

10. The inflator apparatus for inflating a bladder as set forth in claim 9 wherein said inflator apparatus includes a switch mounted at said air outlet for controlling the operation of said motor, said switch being activated by one of said ears when said transition structure is mated at said air outlet.

11. The inflator apparatus for inflating a bladder as set forth in claim 8 wherein said transition structure has a flange forming a groove thereon and including a tether ring with a plurality of tethers extending therefrom, said tether ring being retained on said transition structure by positioning said tether ring in said groove and each of said tethers having an adapter secured thereto.

12. The inflator apparatus for inflating a bladder as set forth in claim 8 wherein said transition structure outlet has a transition structure tapered outlet tube portion with an outlet opening at the distal end thereof and wherein each of said adapter inlet has an adapter tapered inlet tube portion that fits within the outlet opening of said transition structure.

13. The inflator apparatus for inflating a bladder as set forth in claim 12 wherein each of said adapter outlets has an adapter tapered outlet tube portion having an opening extending along a portion of the outer surface from the distal end thereof that is adapted to fit into said valve.

14. The inflator apparatus for inflating a bladder as set forth in claim 13 wherein said adapter tapered outlet tube portion is formed of pliable material.

* * * * *